US005381119A

United States Patent [19]

Robbins et al.

[11] Patent Number: 5,381,119

[45] Date of Patent: Jan. 10, 1995

[54] CIRCUIT BREAKER TRIP UNIT INTERLOCK

[75] Inventors: W. Dale Robbins, Snellville; Curtis J. Ayers, Lithonia; David A. Leone, Lawrenceville, all of Ga.

[73] Assignee: Siemens Energy & Automation, Inc., Alpharetta, Ga.

[21] Appl. No.: 35,350

[22] Filed: Mar. 22, 1993

Related U.S. Application Data

[62] Division of Ser. No. 832,548, Feb. 7, 1992, Pat. No. 5,239,144.

[51] Int. Cl.[6] ..... H01H 67/02

[52] U.S. Cl. ..... 335/132; 335/202; 200/309

[58] Field of Search ..... 335/132, 202; 200/303, 200/304, 305, 309

[56] References Cited

U.S. PATENT DOCUMENTS 3,949,333 4/1976 Freitag et al. ..... 335/132

5,027,091 6/1991 Lesslie et al. ..... 335/202

*Primary Examiner*—Lincoln Donovan

[57] ABSTRACT

A circuit breaker including a trip unit interlock. The trip unit interlock provides a trip unit having a plug connectable with a mating plug which is slidable with respect to the circuit breaker. The trip unit engages a pair of pins mounted to the circuit breaker when the trip unit is in its operating position. The pins are oriented to prevent separation of the plug from the receptacle during circuit breaker tripping. Since it is undesirable to insert a trip unit into a circuit breaker where the trip unit is not compatible with the circuit breaker, the pins and openings in the trip unit are configured such that they will not mate if the trip unit is not appropriate for the circuit breaker. When the trip unit is in its operating position, the trip unit holds an interlock lever for the contact operating mechanism of the circuit breaker in a position where the contact operating mechanism may close the contacts and hold the contacts closed when the circuit breaker is in its ON state.

11 Claims, 2 Drawing Sheets

CIRCUIT BREAKER TRIP UNIT INTERLOCK

This is a divisional, of application Ser. No. 07/832,548 filed Feb. 7, 1992.

FIELD OF THE INVENTION

The present invention relates to a circuit breaker and more particularly to a trip unit interlock mechanism which prevents actuation of the circuit breaker without a trip unit installed.

BACKGROUND OF THE INVENTION

An unsafe condition exists if a circuit breaker can be energized without a trip unit installed. The possibility of undesired closure, and subsequent energization is inherent in circuit breakers with interchangeable tripping units.

To minimize the risk of inadvertent closure of a circuit breaker, interlocking mechanisms of some complexity have been devised which generally require adjustment during assembly, some form of manual locking motion to assure secure installation, and some thought prior to assembly. Usually the interlock blocks the action of closing the circuit breaker through an interposing member or causes the rapid discharge of the closing energy to be diverted from the closing links preventing contact closure.

Circuit breakers of the type contemplated herein are used to protect electrical distribution circuits and apparatus. Electronic trip units provide tripping parameters such as overcurrents and time delays. However, it is important to prevent operation of the circuit breaker in the absence of a properly rated trip unit. By way of example, a system of this type is shown in U.S. Pat. No. 4,000,478, entitled "Static Trip Molded Case Circuit Breaker Including Trip Interlock," issued Dec. 28, 1976, to Jencks, et al.

Typically, circuit breakers require the presence of a trip unit before the circuit breaker system can be operated. For example, a circuit breaker may include a trip unit which is located in a housing recess by guide pins mounted on a plate in the housing. Corresponding holes are provided in the end of the trip unit to matingly engage the guide pins. The pins and holes are arranged in identical patterns such that the pins are received by the holes. Circuit interrupters having different electrical characteristics have rejection pins arranged in patterns different from the holes. The pin patterns and hole patterns for compatible circuit interrupters and trip units are the same, such that only trip units having circuitry compatible with the particular circuit interrupter can be properly inserted in the housing.

SUMMARY OF THE PRESENT INVENTION

The present invention provides a trip unit interlock arrangement for a circuit breaker of the type including a contact operating mechanism, a movable member arranged to disable and enable the operating mechanism, and a circuit breaker housing base. The arrangement also includes a trip unit including an electrical plug, a housing and a first engaging arrangement; a plug receptacle engageable with the electrical plug; and a second engaging arrangement compatible with the first engaging arrangement. The arrangement also includes means for slidably mounting the plug receptacle to the housing base and mounting the second engaging arrangement relative to the means for slidably mounting; and means for holding the trip unit in a first position. In the first position, the plug engages the receptacle, and the first and second engaging arrangements are engaged. Additionally, while in the first position, the trip unit holds the member in an enabled position to enable the operating mechanism.

The present invention further provides a circuit breaker including a movable member operable to disable and enable a contact operating mechanism; a circuit breaker housing base; a trip unit including an electrical plug; a housing and a first engaging arrangement; a plug receptacle engageable with the electrical plug; a second engaging arrangement compatible with the first engaging arrangement; and means for slidably mounting the plug receptacle to the housing base and mounting the second engaging arrangement relative to the means for slidably mounting. The circuit breaker also includes for holding the trip unit in a first position. In the first position, the plug engages the receptacle, and the first and second engaging arrangements are engaged. The trip unit, while in the first position, holds the member in an enabled position to enable the operating mechanism.

A feature of the invention is to provide a circuit breaker trip interlock for a circuit breaker mechanism which has a relatively simple operation in that it is only responsive to the presence of the proper trip unit in the housing. Another feature of the present invention is to provide mechanical means for holding the trip unit electrical plug and circuit breaker plug receptacle in engagement.

Other features and advantages of the invention will become apparent to those skilled in the art upon review of the following drawings, the detailed description and the appended claims.

DETAILED DESCRIPTION OF THE PREFERRED EMBODIMENTS

Figure 3:
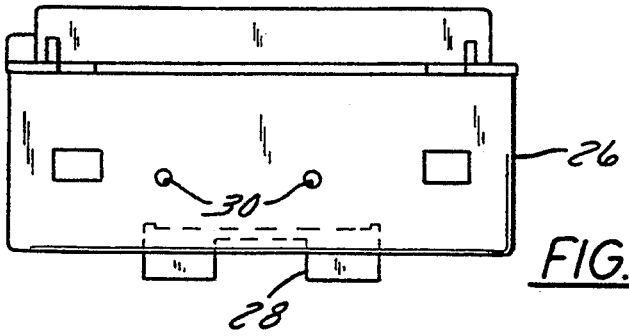
FIG. 3 is a view of a hole pattern for the trip unit.
Figure 4:
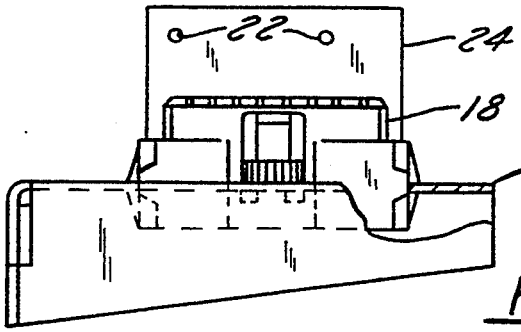
FIG. 4 is a view showing a rejection pin pattern for the trip unit corresponding to the pattern of FIG. 3.
Figure 1:
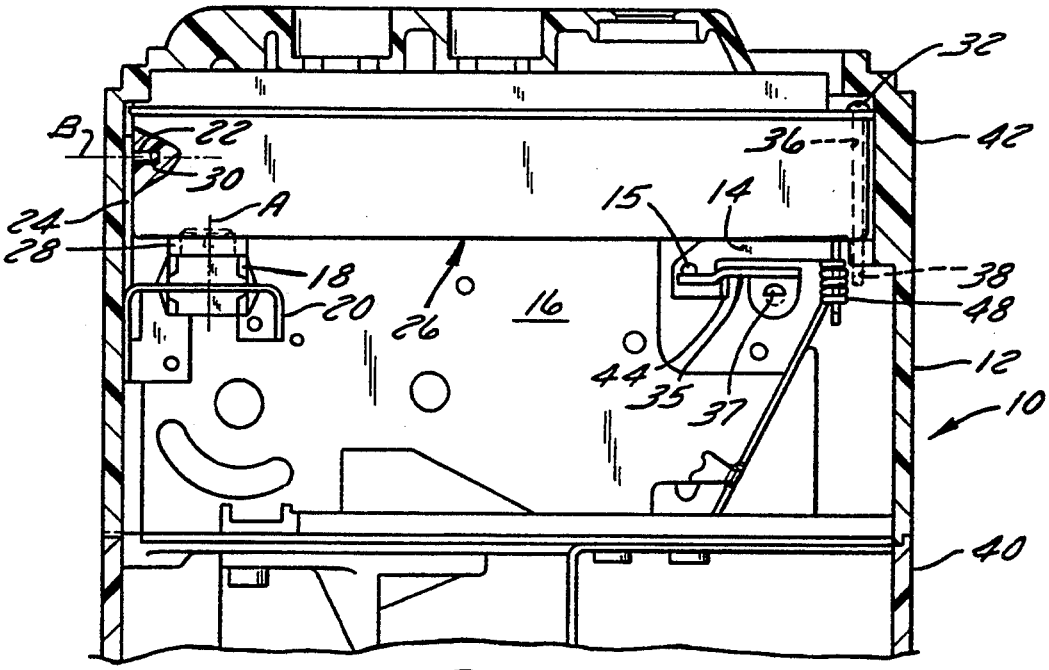
FIG. 1 is a cross-sectional view of the circuit breaker housing showing the trip unit mounted in the circuit breaker housing.
Figure 2:
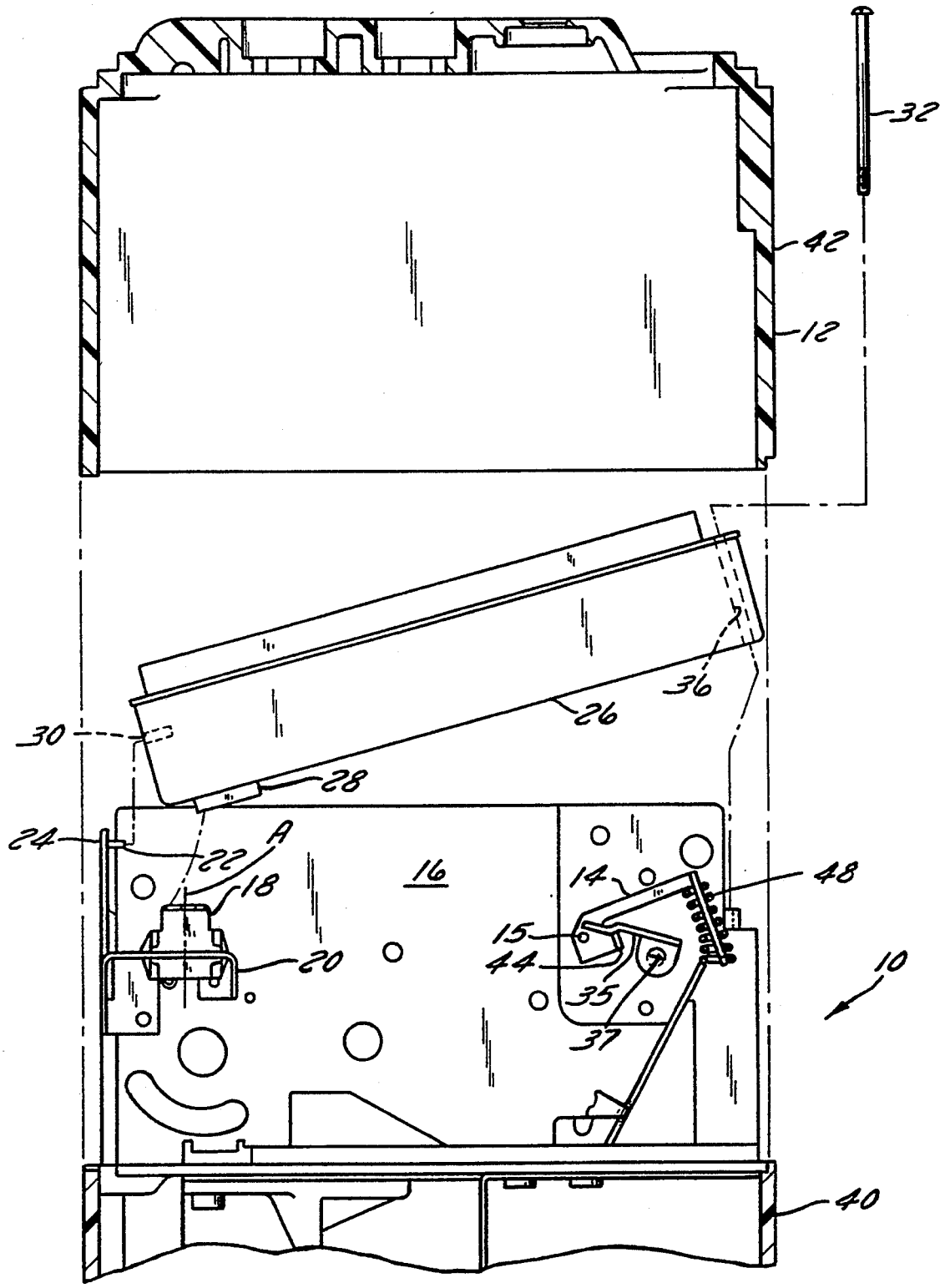
FIG. 2 is an exploded view of FIG. 1 showing the trip unit in a position for mounting in the housing with the tripping interlock assembly in an open position.

As seen in FIGS. 1 and 2 of the drawings, a switching device such as a circuit breaker 10 includes a circuit breaker contact operating mechanism (not shown in detail) which is housed within a housing 12 having a base 40 and a cover 42. A tripping interlock lever 14 is pivotally supported by a pin 15 provided on a support member, which is part of a circuit breaker, such as an operating mechanism support member 16 supported by base 40 of circuit breaker 10. The member 16 is part of the circuit breaker support frame (not shown in detail). An electrical connector in the form of a trip unit receptacle 18 is slidably mounted on a support bracket 20 which is supported by member 16. The receptacle 18 is positioned on bracket 20 in a spaced relation to an engaging arrangement. In the preferred embodiment, the engaging arrangement (formation) is a set of rejection pins 22 mounted on a plate 24 which is supported by member 16. Receptacle 18 is slidably supported by bracket 20 such that receptacle 18 may slide toward and away from the set of rejection pins 22, and may be biased away from the rejection pins 22 by a spring arrangement (not shown).

A trip unit 26 is removably mounted relative to the member 16. The trip unit 26 is provided with an electrical connector in the form of a trip unit plug 28 and an engaging arrangement (formation), such as a set of openings 30 at one end thereof. The trip unit 26 is mounted within a receptacle defined by member 16, plate 24 and a cover 42 of the circuit breaker 10 by aligning the trip unit plug 28 with the receptacle 18 and engaging the plug 28 with the receptacle 18 by translating the trip unit along a path defined by axis A. The trip unit 26 is simultaneously seated on the interlock lever 14 and moved toward the pins 22. If the openings 30 in the end of the trip unit matingly engage (are compatible with) the rejection pins 22 the proper trip unit 26 has been provided, and pins 22 will engage openings 30 along an axis (path) B which is oriented generally transverse to the trip unit translation path defined by the axis A. By way of example, the trip unit 26 is an electronic unit which operates in a conventional manner to cause the operating mechanism to open the circuit breaker contacts under adverse conditions, e.g., ground fault or overload.

In this regard, the rejection pins 22 are oriented in various spatial configurations depending on the breaker frame rating. The holes or openings 30 in the trip unit 26 are arranged to match the arrangement of the rejection pins 22 so that the proper trip unit 26 is mounted on the circuit breaker assembly. When the trip unit 26 has been plugged into the receptacle 18, it is moved into engagement with the rejection pins 22 by sliding the receptacle 18 along the bracket 20. Once the trip unit is matched with the proper rejection pins 22, the rejection pins 22 prevent upward movement of the trip unit 26 along the translation path defined by axis A and disconnection of the trip unit plug 28 from the trip unit receptacle 18. When a circuit breaker trips under conditions such as a short circuit condition, the jarring of the circuit breaker due to tripping may disconnect the plug 28 of trip unit 26 from receptacle 18, where the above-described arrangement is not used. If the trip unit 26 is properly assembled, the trip unit 26 can be seated on the base 40 with the tripping interlock lever 14 held in the down or enabling position. A mounting screw 32 is passed through an opening 36 in the trip unit 26 and a threaded opening 38 in the base, to hold the trip unit 26 in place.

The tripping interlock lever 14 is pivotally mounted on the pin 15 on the circuit breaker mechanism 10. The lever 14 is biased to an open position by a tripping interlock spring 48 which has sufficient spring force to urge or the tripping unit 26 upwardly, and at least partially separate plug 28 from receptacle 18, if the cover 42 removed. A circuit breaker operating mechanism tripping latch 35 is operatively connected to a rod 37 which is operatively connected to the circuit breaker operating mechanism. The latch 35 is held in the open position, (FIG. 2), by a tab 44 provided on the interlock lever 14, where the circuit breaker operating mechanism is prevented from closing the circuit breaker contacts (disabled). When the latch 35 is moved from its closed position (FIG. 1) to its open position (FIG. 2) by lever 14 and tab 44, the operating mechanism will open the circuit breaker contacts.

When the trip unit 26 is properly seated on the tripping interlock lever 14, the tripping interlock lever 14 is pivoted to a closed position against the compressive force of the spring 48 and allows the latch 35 to move to its closed position. With circuit breaker tripping latch 35 in its closed position, the operating mechanism is permitted to close the contacts (enabled).

To install the trip unit 26, the receptacle 18 and plug 28 are aligned and plugged together. The trip unit and receptacle 18 are then slid into engagement with the rejection pins 22. If the proper pattern for the holes 30 in the trip unit 26 is present, the trip unit 26 will be seated on the panel 24. The opening 36 of the trip unit 26 is aligned with the base 40 and the mounting screw 32 inserted into the opening 36 in the trip unit 26 and the threaded hole 38 in the base 40 to hold the trip unit 26 down against the pressure of the tripping interlock spring 48. In the absence of the mounting screw, the force of the spring 48 is sufficient to push the lever 14 and tripping unit 24 upward thus disabling the operation of the circuit breaker operating mechanism.

Thus, it should be apparent that there has been provided in accordance with the present invention a circuit breaker trip unit interlock that fully satisfies the aims and advantages set forth above. Although the invention has been described in conjunction with specific embodiments thereof, it is evident that many alternatives, modifications and variations will be apparent to those skilled in the art. Accordingly, the present invention is intended to embrace all such alternatives, modifications and variations that fall within the spirit and broad scope of the appended claims.

What is claimed is:

1. A switching device comprising:

a support member including walls defining a receptacle having an opening;

a trip unit for insertion into the receptacle along a rocking motion translation path about a pivot axis which is generally normal to the opening;

a female engagement formation on one of the trip unit and support member wall; and a male engagement formation on the other of the trip unit and support member wall for insertable engagement with the female engagement formation and establishment of the pivot axis, the male engagement formation being oriented along the translation path to prevent inadvertent separation of the trip unit from the receptacle through the opening in the event of an internal pressure build-up within the device during interruption.

2. The device of claim 1, where the female engagement formation includes at least two openings in the trip unit, and the male engagement formation includes at least two pins engageable with the openings.

3. A switching device comprising;

a support member;

a receptacle, defining a receptacle opening, attached to the support member;

a trip unit, insertable into the receptacle along a first path which is generally normal to the opening, including a plug and at least two trip unit openings; and at least two pins, supported by the support member, configured such that the pins are engageable with the trip unit openings along the first path for establishment of a pivot axis, the receptacle and the plug being engageable and disengageable along a second path established by rocking the trip unit about the pivot axis, where the first and second paths are substantially perpendicular and the receptacle and plug are prevented from disengaging when the pins and trip unit openings are engaged.

4. The device of claim 3, further comprising a bracket disposed to couple mechanically the receptacle to the support member and slidably support the receptacle such that the first pins and openings are engageable subsequent to engagement of the receptacle and the plug.

5. A circuit interruption device comprising:

a support member;

a receptacle, defining a receptacle opening, attached to the support member;

a trip unit, insertable into the receptacle along a first path which is generally normal to the opening, including a second electrical connector and a first engagement formation; and a second engagement formation supported by the support member, the first and second engagement formations being engageable along the first path for establishment of a pivot axis, and the first and second electrical connectors being engageable and disengageable along a second path established by rocking the trip unit about the pivot axis, where the first and second paths are substantially perpendicular and the electrical connectors are prevented from disengaging, in the event of an internal pressure build-up within the device during interruption, when the formations are engaged.

6. The device of claim 5, where the first electrical connector is a receptacle and the second electrical connector is a plug.

7. The device of claim 5, where the first engagement formation includes at least two openings and the second engagement formation includes at least two pins configured such that the pins are engageable with the openings along the first path.

8. The device of claim 5, further comprising a bracket disposed to mechanically couple the first electrical connector to the support member and slidably support the first electrical connector such that the first engagement formation is engageable with the second engagement formation along the first path subsequent to engagement of the connectors.

9. The device of claim 1, wherein the male and female engagement formations are oriented in a corresponding spatial configuration in order to reject any trip unit which does not have a rating which is compatible with the device.

10. The device of claim 3, wherein the trip unit openings and pins are oriented in a corresponding spatial configuration in order to reject any trip unit which does not have a rating which is compatible with the device.

11. The device of claim 5, wherein the first and second engagement formations are oriented in a corresponding spatial configuration in order to reject any trip unit which does not have a rating which is compatible with the device.

* * * * *